United States Patent [19]

Fegley et al.

[11] 4,258,613

[45] Mar. 31, 1981

[54] PAPER TUBE WINDERS AND CUT OFF SAWS

[75] Inventors: Richard F. Fegley, Warrington; Steven R. Kiss, Fort Washington, both of Pa.

[73] Assignee: PACO Winders, Inc., Philadelphia, Pa.

[21] Appl. No.: 24,507

[22] Filed: Mar. 28, 1979

[51] Int. Cl.[3] ..... B31C 3/00

[52] U.S. Cl. ..... 493/22; 493/289

[58] Field of Search ..... 93/77 R, 80, 81 R, 82

[56] References Cited

U.S. PATENT DOCUMENTS

| | | | |
|---|---|---|---|
| 2,712,778 | 7/1955 | Robinson | 93/80 |
| 3,068,934 | 12/1962 | Mauck et al. | 93/80 |
| 3,158,074 | 11/1964 | Brigham | 93/80 |
| 3,400,029 | 9/1968 | Mesrobian et al. | 93/80 UX |
| 3,636,827 | 1/1972 | Lindberg | 93/80 |

*Primary Examiner*—James F. Coan

*Attorney, Agent, or Firm*—Frederick J. Olsson

[57] ABSTRACT

Structural improvements in the mechanisms for supporting and driving the blade of an orbital saw. Improvements in the controls for the drive mechanisms for the winder and for the saw blade particularly as to increasing or decreasing the production rate of specified stick lengths.

3 Claims, 14 Drawing Figures

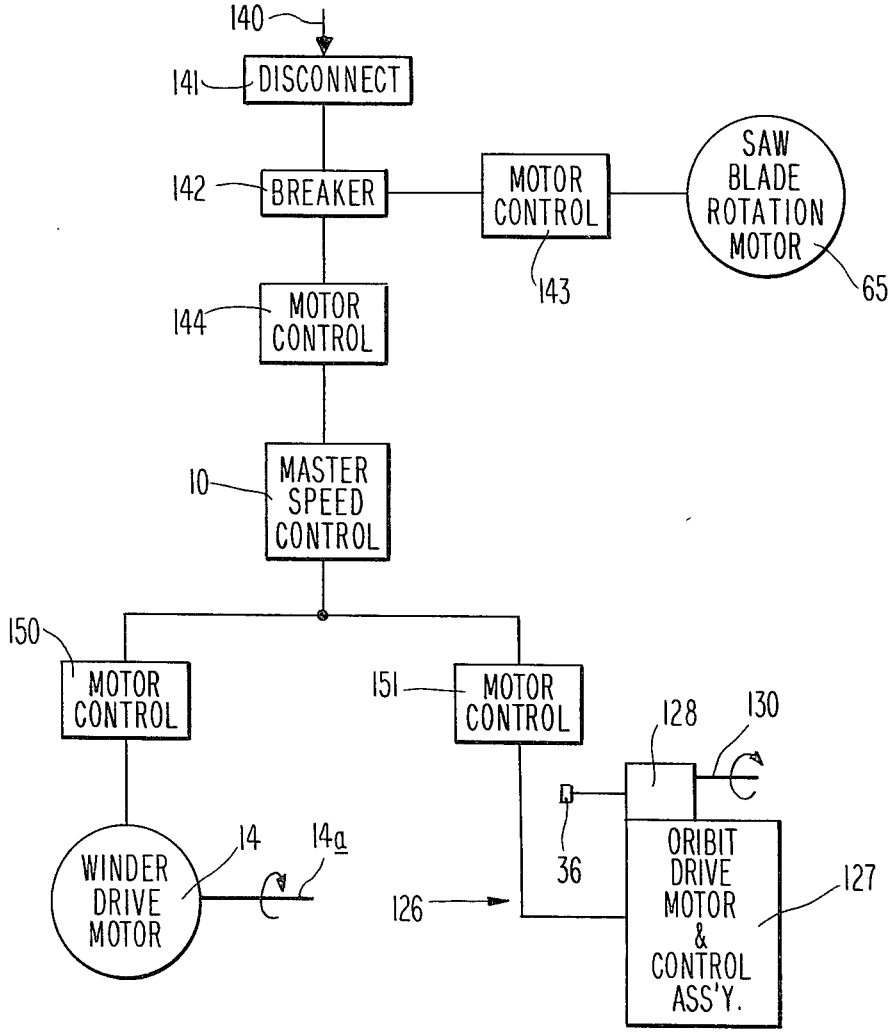
Fig. 8
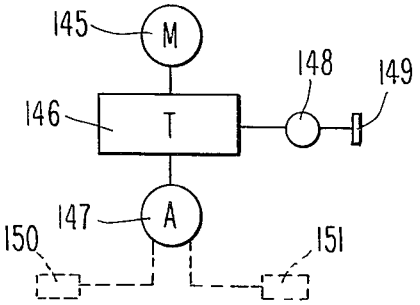
Fig. 8-A
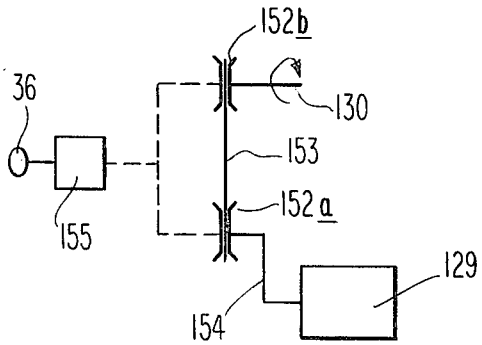
Fig. 8-B

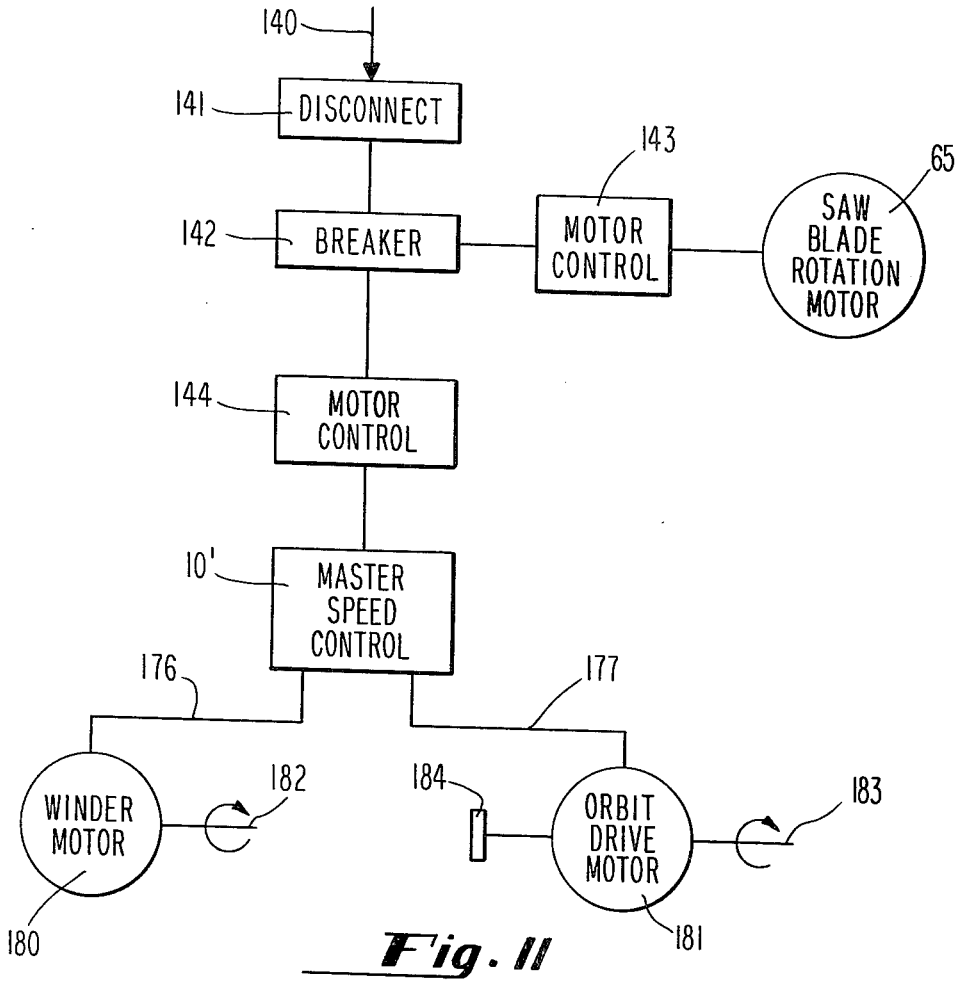
Fig. 11
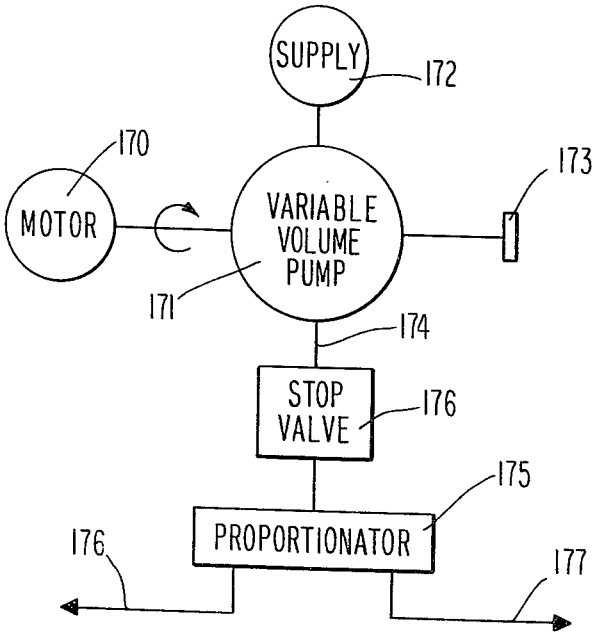
Fig. 11-A

PAPER TUBE WINDERS AND CUT OFF SAWS

The invention relates in general to the manufacture of paper tubes particularly to such manufacturing employing a spiral winder for tube fabrication and an orbital saw for cutting the tube into desired lengths or sticks.

In one aspect the invention provides new and improved structure in the orbital saw having several practical and desirable advantages, for example:

(a) reduction in the overall physical size of the machine with attendent reduction in component cost, weight reduction and savings in floor space.

(b) mounting of the moving parts in a manner to minimize vibration or shaking and thereby avoid transient shocks on critical parts such as the saw blade and a cam follower.

In another aspect the invention contemplates improved non-mechanincal means connected between winder and saw which permits setting the stick length and rate and then instantaneously substantialy increasing or decreasing that rate while maintaining the stick length.

The non-mechanical concept providing for instantaneous change in rate has several important advantages, for example:

(a) neither the winder nor the saw has to be shut down with consequent saving in production time.

(b) neither the winder nor the saw has to be independently adjusted with consequent saving in labor and production time.

(c) mechanical connections between winder and saw are eliminated with consequent reduction in manufacturing and installtion/costs and very substantial reduction in maintenance costs.

(d) very substantially improves reliability and accuracy.

(e) permits the tube winding operation to be done at rates considerable above the rates for conventional equipment with savings in unit production costs.

(f) without mechanical interconnections there is greater accessibility to the winder and saw.

(g) greatly increases the ability to space the winder and saw at distances approaching 30 feet.

The invention contemplates the non-mechanical system to comprise an electrical power and control arrangement or an electric-hydraulic power control arrangement.

In another aspect the invention contemplates an instantly operable system for increasing the length of stick by automatically retracting the saw blade so that it skips any number of cuts. Where sticks of given length are being cut, the stick length may be instantly multiplied by virture of the skip-cut system.

The invention will be described below in connection with the following drawings wherein:

FIG. 8 is a block diagram illustrating an electrical power and control arrangement for the winder and the saw;

Figure 9:
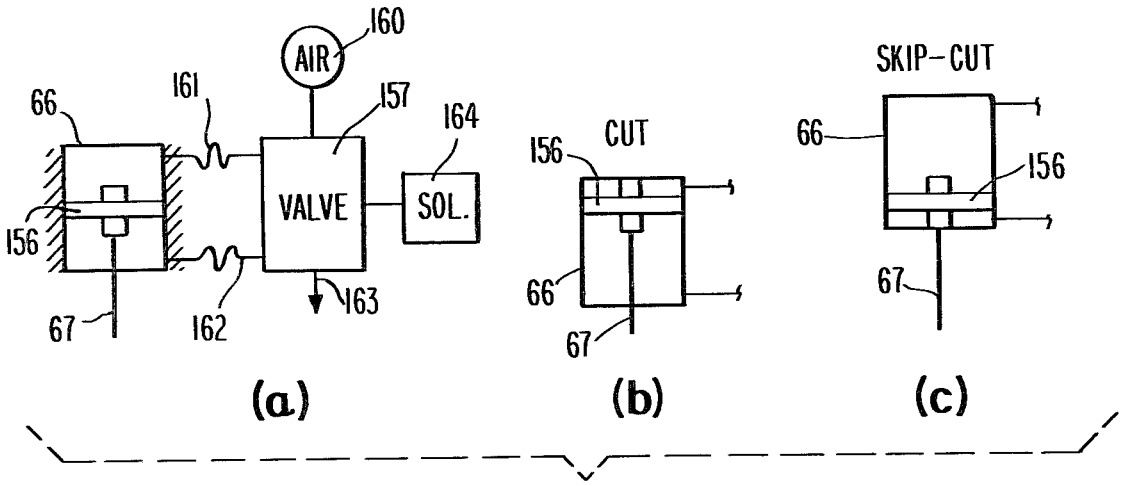
Figure 10:
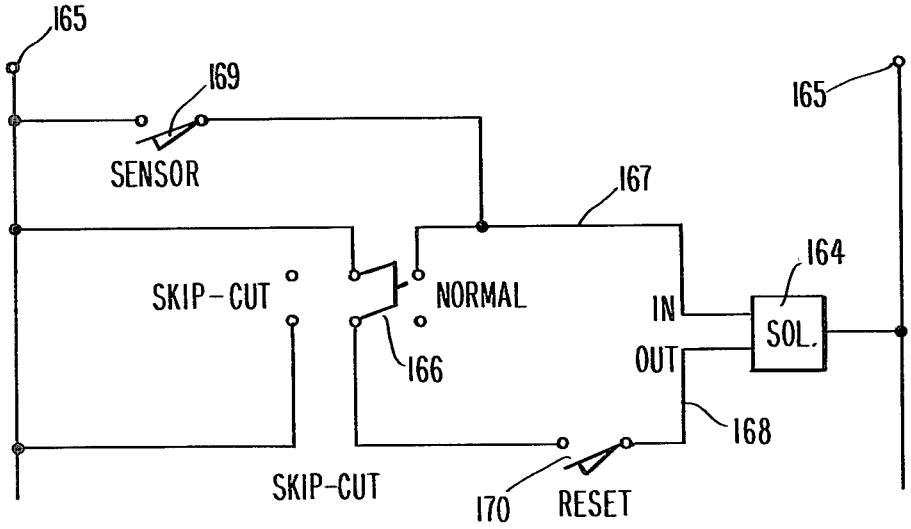

FIG. 8-A is simplified block diagram of the master speed control means in the diagram of FIG. 8 and FIG. 8-B diagramatically represents the orbit drive motor and control of FIG. 8;

FIG. 9 parts (a), (b) and (c) are diagramatic representations of means to control the operative condition of the saw blade;

FIG. 10 is a circuit diagram for effecting the normal and the skip-cut conditions; and FIG. 11 is a block diagram illustrating an electrical/-hydraulic power control arrangement for the winder and the saw and FIG. 11-A illustrates the master speed control of FIG. 11.

Figure 1:
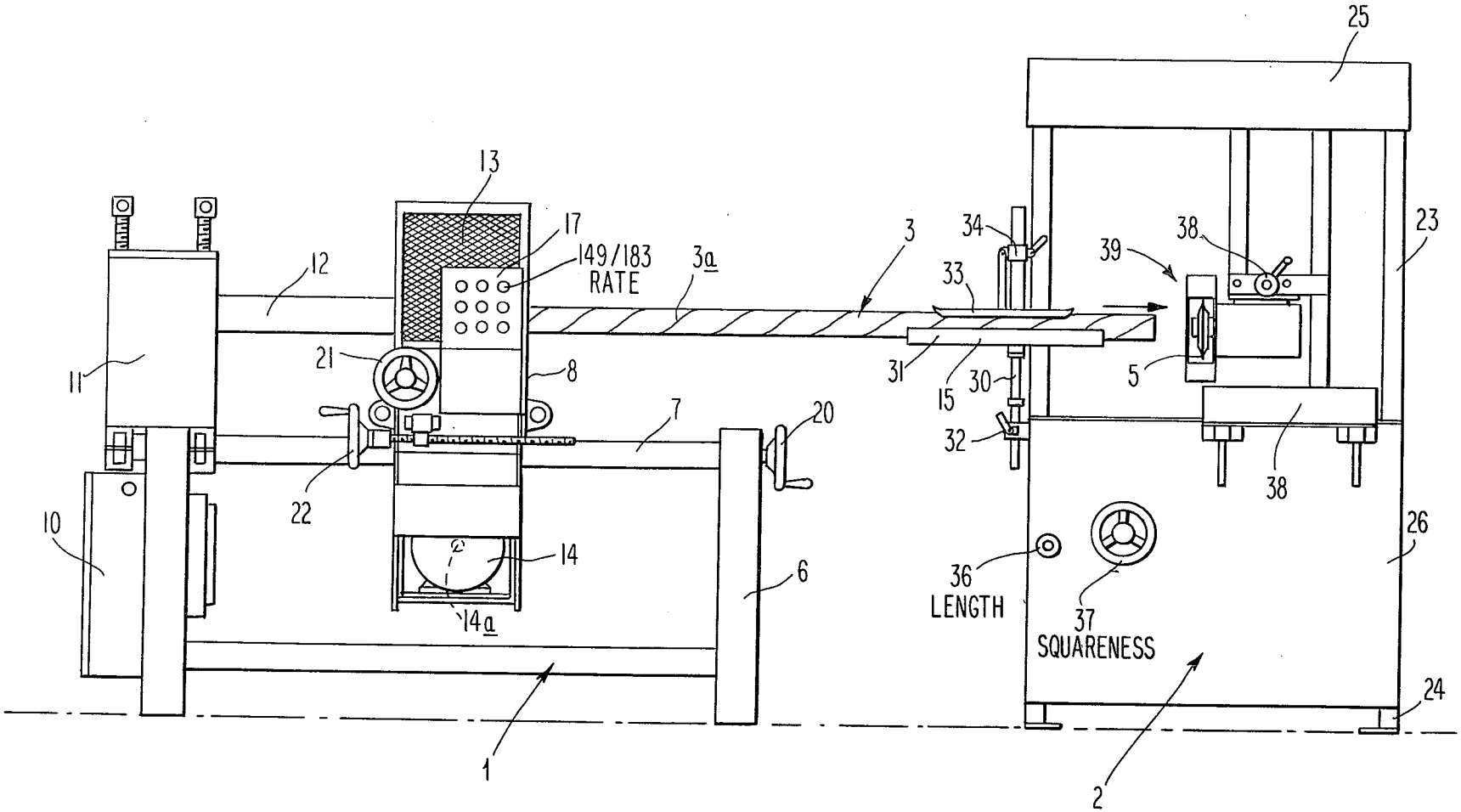
FIG. 1 is a front elevational view of a spiral winder and an orbital saw machine having the improvements disclosed herein.
Figure 2:
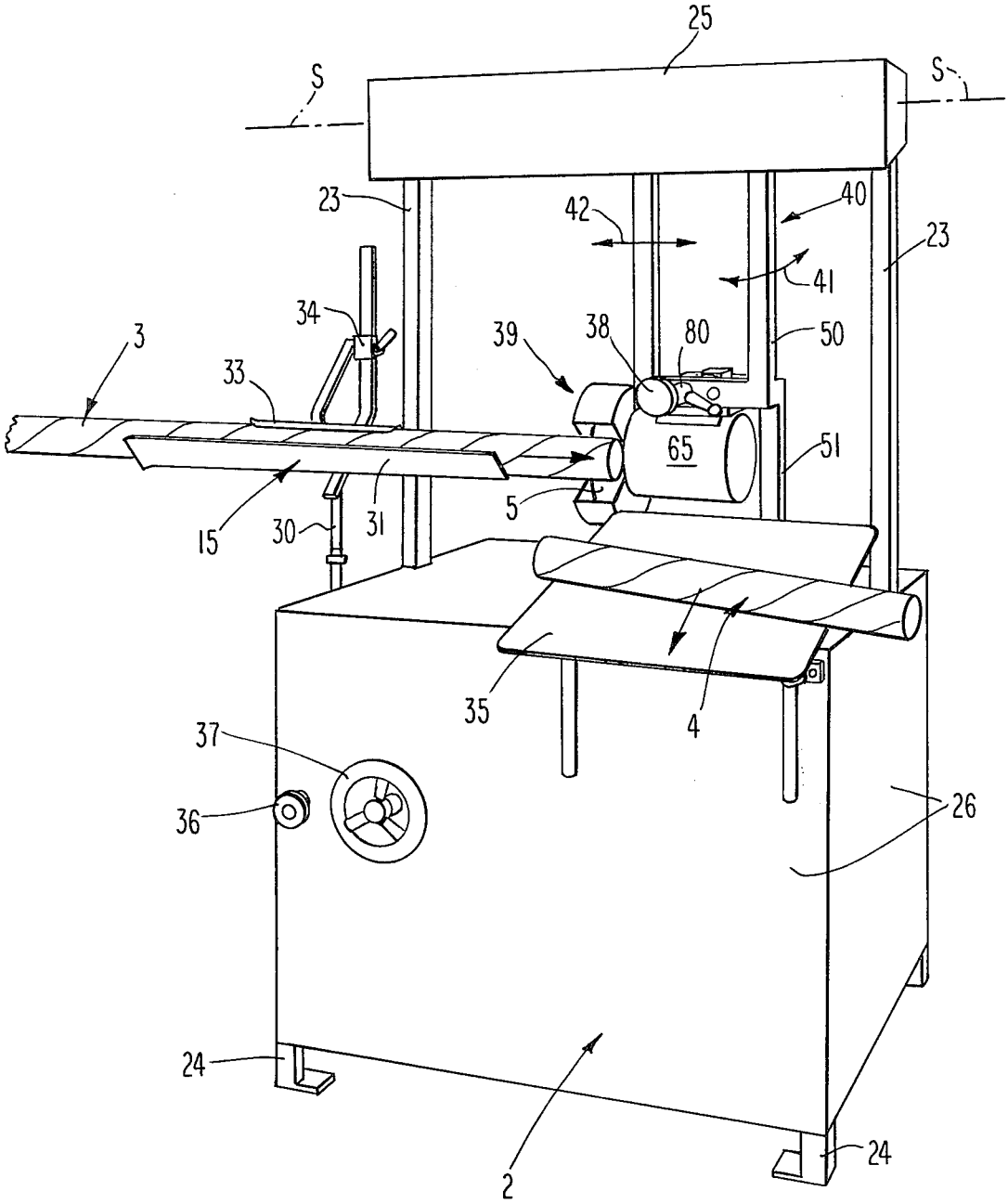
FIG. 2 is a perspective view of the oribital saw machine of FIG. 1.

In FIGS. 1 and 2 we have a illustrated spiral winder 1 and an orbital saw 2. The winder continuously forms tubing 3 which is delivered to the saw to be cut into tube sections or sticks 4 by the saw blade 5. Except for certain improvements described and claimed herein, the winder and saw are conventional.

The blade 5 is mounted to move in a horizontal, elliptical path a portion of which is generally parallel the tube axis and is substantially linear. For cutting, the blade (while rotating) is moved along this linear (axial) portion at the same linear speed as the tube.

The spacing between the winder and the saw normally will fall within the range of five to thirty fee. The spacing largely depends upon the setting time for the adhesive and the linear speed of the tube.

The length of the sticks and the rate at which they are cut is a function of the linear axial speed of the tube 3 and of the orbital speed of the blade 5. This requires coordination between the drive system for the winder mechanism and the drive system for the saw.

In some conventional winder/saw set-ups the necessary coordination is attained by the independent adjustment of the two machines. In other conventional set-ups, the necessary coordination is attained by mechanical connections (shafts; joints; timing belts; etc) between winder and saw. These conventional arrangements have many disadvantages such as, for example: high cost; excessive maintence; difficult and time consuming to effect size and/or rate change; mediocre accuracy and reliability; inhibits line configuration; wastes floor space.

With the present invention mechanical connections are eliminated and there is no independent adjustment. After the machines are set up to produce sticks of a desired length and rate, the rate may be substantially increased, say double, (or decreased) without change in length by the mere twist of a control knob or the push of a button. The manner in which this is accomplished will be treated after the description of the certain structural elements of the winder and the saw. First we comment on the general arrangement of the winder 1.

The winder 1 has framing 6 including guide way 7 supporting winding carriage 8 which can be adjusted back and forth along the guide. At the left hand end, the framing supports the master speed control 10 and the mandrel support 11 carrying the mandrel 12. The support 11 accepts mandrels of various diameters and positions same as desired in the vertical direction.

The winding carriage 8 carries the drive system including winding mechanism (not shown) behind the screen 13 and drive motor 14. The winding mechanism draws adhesively coated paper strips over the mandrel 12 staggered in overlaping helixes to form the tube 3. The outer helical joint is noted at 3*a*. The formed tubing is fed at some desired rate into tube support 15 on the saw. The drive motor 14 has an output or drive shaft 14*a* the speed of which determines the speed of the winding operation hence the linear speed of the tube 3.

The carriage mounts a control panel 17 which carries various push-type switches for controlling the winding operation.

The hand wheel 20 is for positioning the carriage 8 along the guide 7. The hand wheel 21 is for aliging the winding mechanism with respect to the mandrel 12 and the hand wheel 22 is for angularly orienting the winding mechansim with respect to the mandrel.

Figure 3:
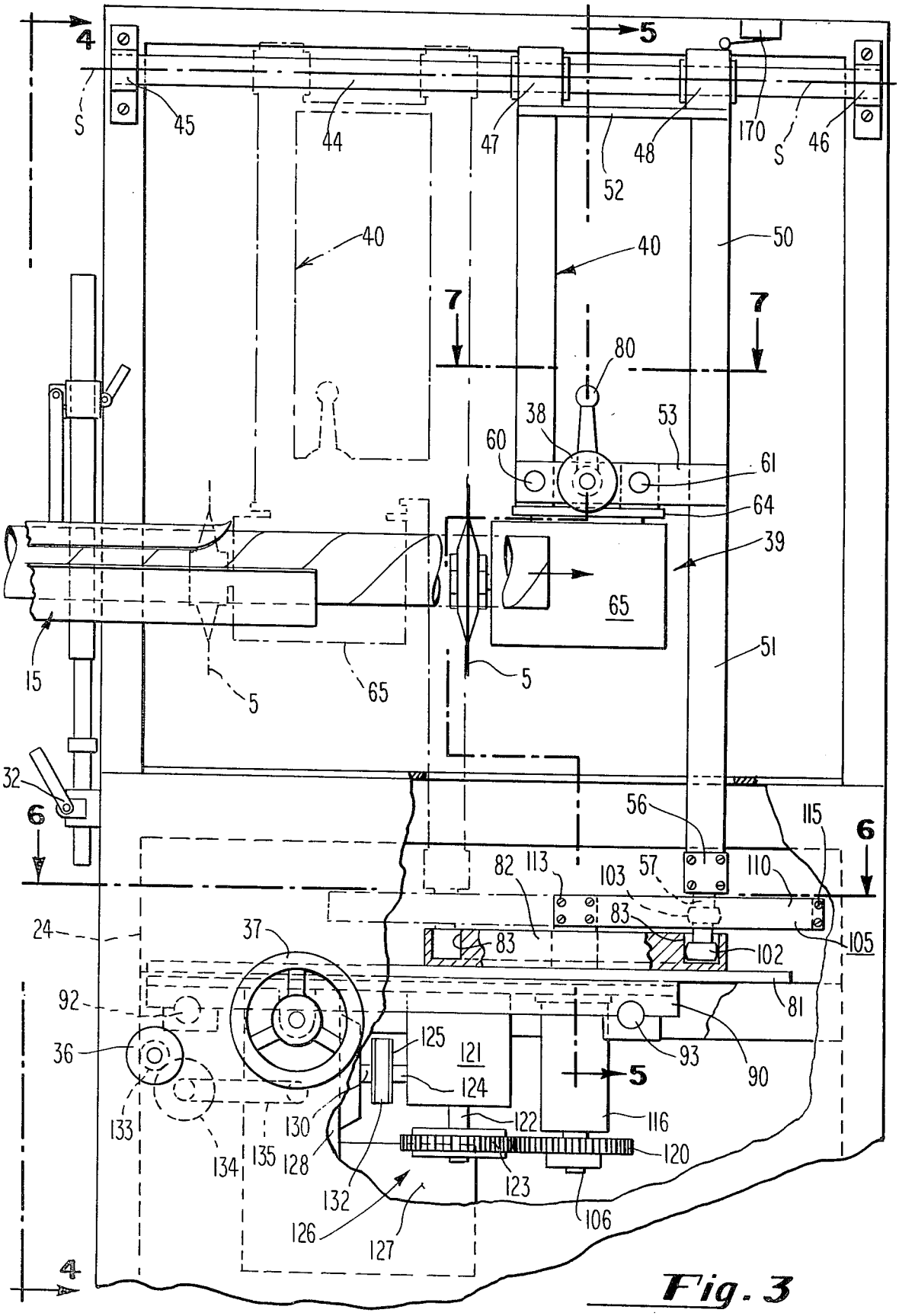
FIG. 3 is an enlarged fragmentary view with certain portions broken away from the apparatus of FIG. 2.
Figure 4:
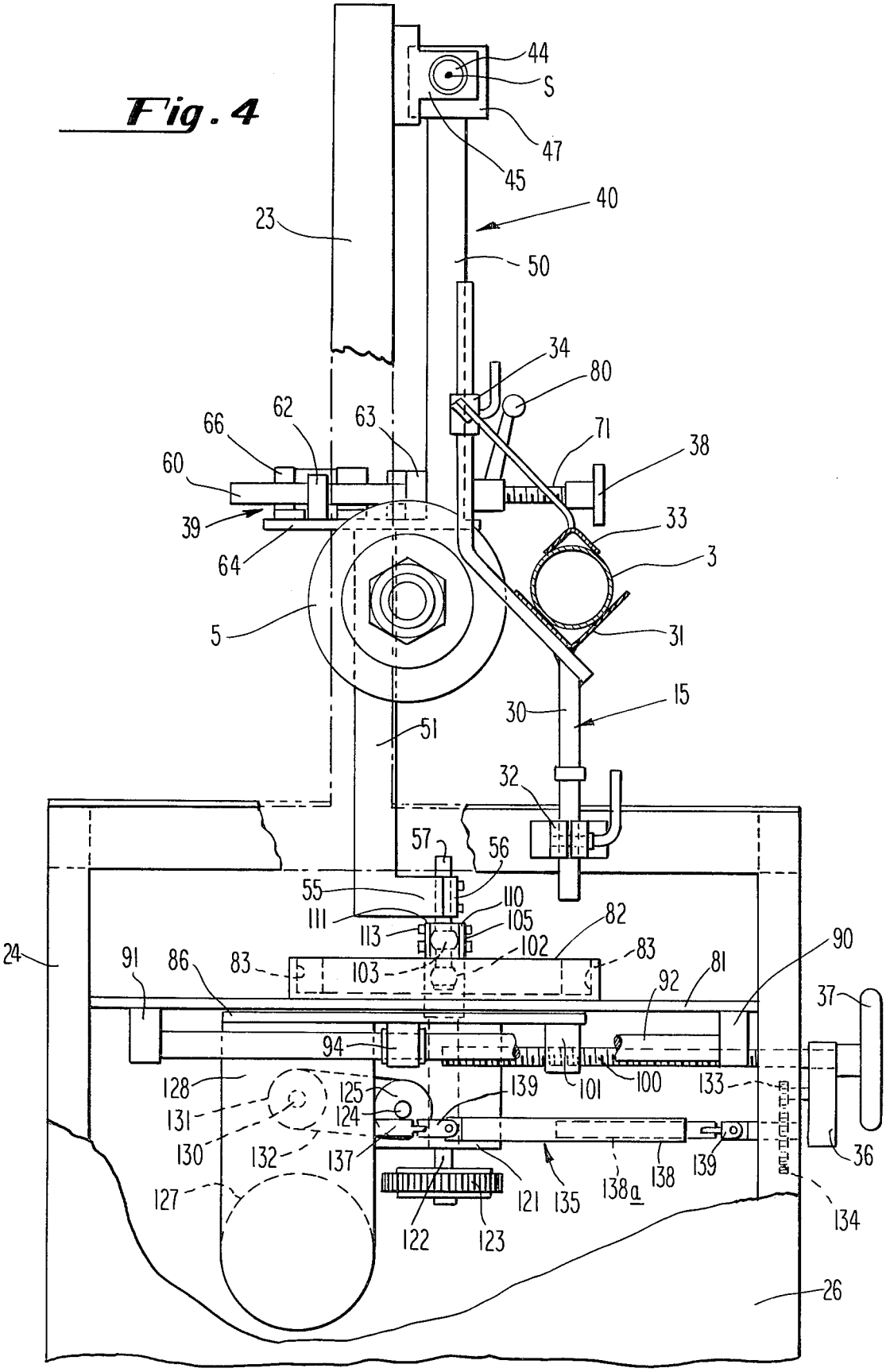
FIG. 4 is a side elevational view taken along the lines 4—4 of FIG. 3.

With reference to FIGS. 2, 3, & 4 we will now comment on the general arrangement of the saw 2.

The saw 2 has frame means the upper postion of which is indicated at 23 and the lower portion of which is indicated at 24. The upper portion 23 carries a cover 25 and the lower portion 24 carries panels 26.

As best noted in FIG. 4, a tube support 15 has a column 30 carrying the V-shaped channel 31. The column is vertically adjustable by the clamp 32. A tube holdown 33 is connected to the column by clamp 34.

The front panel 26 carries the stick chute 35 which is vertically adjustable by clamps not shown.

Mounted on the lower frame 24 and extending over the face of front panel 26 are the hand wheels 36 and 37 which are readily available to an operator standing in front of the saw and viewing the cut. Also available to the operator is hand wheel or knob 38. The wheel 38 is employed in adjusting the saw blade to tube diameter and the depth of cut.

The wheel 36 is used in determining the length of stick to be cut and the wheel 37 used in making the cut square. These adjustments will be explained later:

In the material which follows we will explain how the blade 5 is mounted so that it will move in a horizontally oriented elliptical path or orbit.

Referring to FIG. 2, the saw blade 5 is mounted on a saw motor assembly 39 carried at the lower end of a saw blade frame 40. The frame 40 is mounted for swinging motion about the axis S (see arrows 41) and for back and forth movement parallel to the axis S (see arrows 42). The swinging motion is further indicated by the dotted lines 5 in FIG. 5 and the back and forth movement by the dotted lines 40 in FIG. 3.

Figure 6:
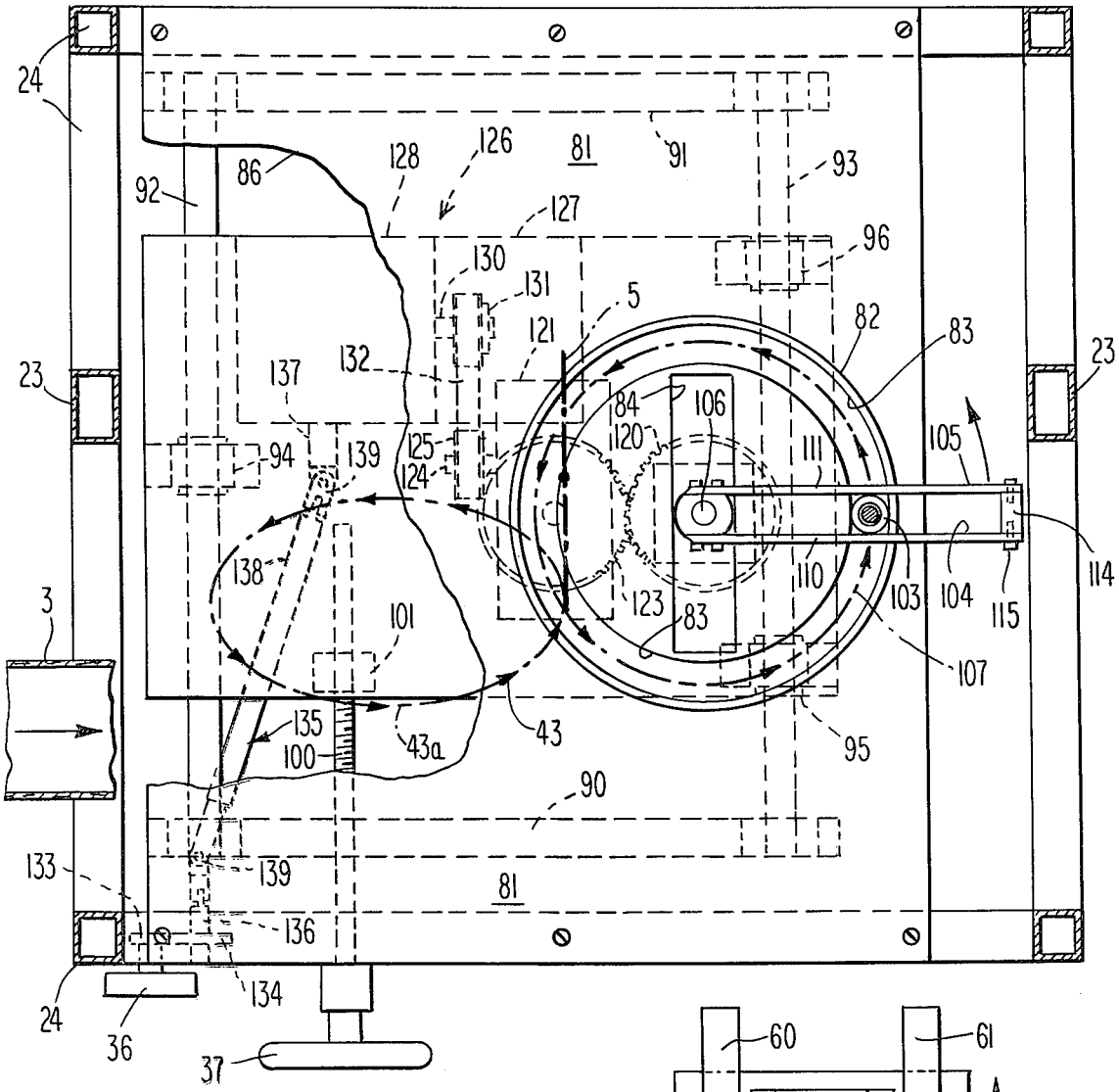
FIG. 6 is a plan view taken along the lines 6—6 of FIG. 3.

With the above components of motion, it will be apparent that if the blade 5 is moved generally parallel to the axis of the tube (to the right in FIG. 2) and then swung away from the tube, reversed in direction, swung back toward the tube and again reversed in direction and the motion continuously repeated, the tip of the blade will follow an elliptical path such as the path 43 in FIG. 6.

The portion 43*a* of the path is substantially linear in the sence that the speed of the blade in this area very closely approximates the linear speed of the tube. The closer the linear speeds the more square the cut.

It will be understood of course that the locus of the plane of the path 43 is not exactly planar since the blade swings on a fixed radius. The plane is somewhat concave in an upward direction. The descrepency is slight and for practical purposes can be ignored and the plane considered as horizontal.

The stucture providing for the blade 5 to partake of the above motion has several important features and this structure will now be described.

For the swinging and reciprocating motion mentioned above, the saw blade frame 40 is supported by the main slide shaft 44 whose axis is the axis S. The shaft 44 is carried by blocks 45 and 46 connected adjacent the top of upright frame 23. The blocks orient the axis S of the shaft parallel the tube axis and firmly hold the shaft against axial and radial movement. The saw blade frame 40 is connected to the shaft by recirculating bearings 47 and 48. The bearings 47 and 48 permit the frame to swing and move axially with respect to the shaft.

The recirculating bearings are an important part of the structure as they practically eliminate play and commensurately reduce transient loads otherwise developed by shaking of the frame 40 due to the mass of the saw motor assembly 39 as it whips thru the elliptical path. It is undesirerable that such loads be imposed on the main slide shaft 44 and its mounting blocks 45 and 46 and other parts of the machine as will be noted later.

The frame 40 is constructed of square tubing and has an upper rectangular shaped part 50 and an arm-like lower part 51.

A top plate 52 on the upper part 50 supports the bearings 47 and 48. A lower solid cross piece 53 supports the saw motor assembly 39. The piece 53 has the same demensions as the tubing.

Figure 7:
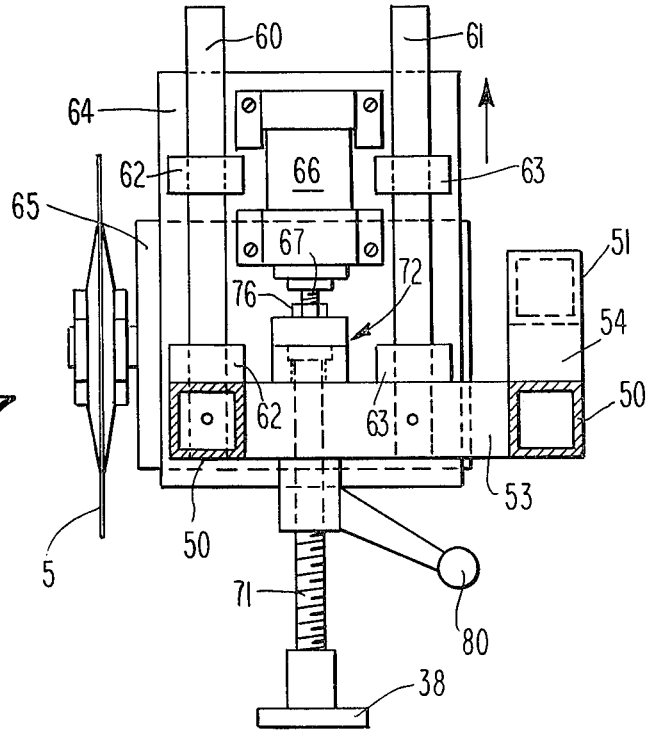
FIG. 7 is a plan view taken along the lines 7—7 of FIG. 3.

With reference to FIGS. 2, 4 & 7 it will be noted that the lower part 51 of frame 40 is off-set (to the rear) from the upper part 50. The off-set is provided by the section 54 (FIG. 7) having the same dimensions as the tubing whereby the off-set is the same as the thickness of the tubing. The bottom of the part 51 has a foot 55 (FIG. 4) outer end of which carries a pressure plate assembly 56 releasable holding cam roller stud 57. The off-set arrangement with the foot 55 provides a means for releasable holding the cam roller stud 57 for replacement purposes and for placement in the same vertical plane which contains the tilting reciprocating axis S. As noted, the amount of off-set is held to a minimum and this is important from the standpoint of reducing the over-all size of the machine.

The arrangement mounting the saw motor assembly 39 on the frame 40 will now be described. The mounting arrangement includes control mechanism for setting the blade in a cutting condition or in a skip-cut condition.

As best seen in FIG. 7, a guide means comprising a pair of slide rods 60 and 61 are mounted to extend outwardly from the mid-section of the arm frame 40. The rods are parallel one another and extend generally normal to the vertical plane containing the axis S and the axis of the cam roller stud 57.

The rod 60 carries a set of bearing 62 and the rod 61 carries a set of bearings 63. The bearings support a saw mounting plate 64 and provide for the plate to be adjusted or moved back and forth on the rods. On its underside, the plate 64 carries the saw drive motor 65 for rotating the saw blade 5. The motor 65 and saw blade 5 move with the plate 64.

On its top side, the plate 65 fixedly mounts an air cylinder 66 carrying a piston connected to the externally extending threaded rod 67. The rod (and its piston) is connected to the frame 40 and can be adjusted to a fixed position with respect to the frame. The cylinder is moved relative to the piston under the control of two-way solenoid operated valve mounted on the frame 23 and connected to the cylinder by flexible lines.

The air moves the cylinder (and therefore blade 5) toward or away from the tube 3 and bottoms or fixes the cylinder against piston. This fixes the blade 5 in the cutting or skip-cut condition. The position of the piston therefore determies the position of the blade 5 in the above conditions. The manner of moving the cylinder will be explained in connection with FIG. 10.

The manner in which the piston rod 67 (and its piston) are adjustably connected to the frame 40 is explained as follows.

Figure 5:
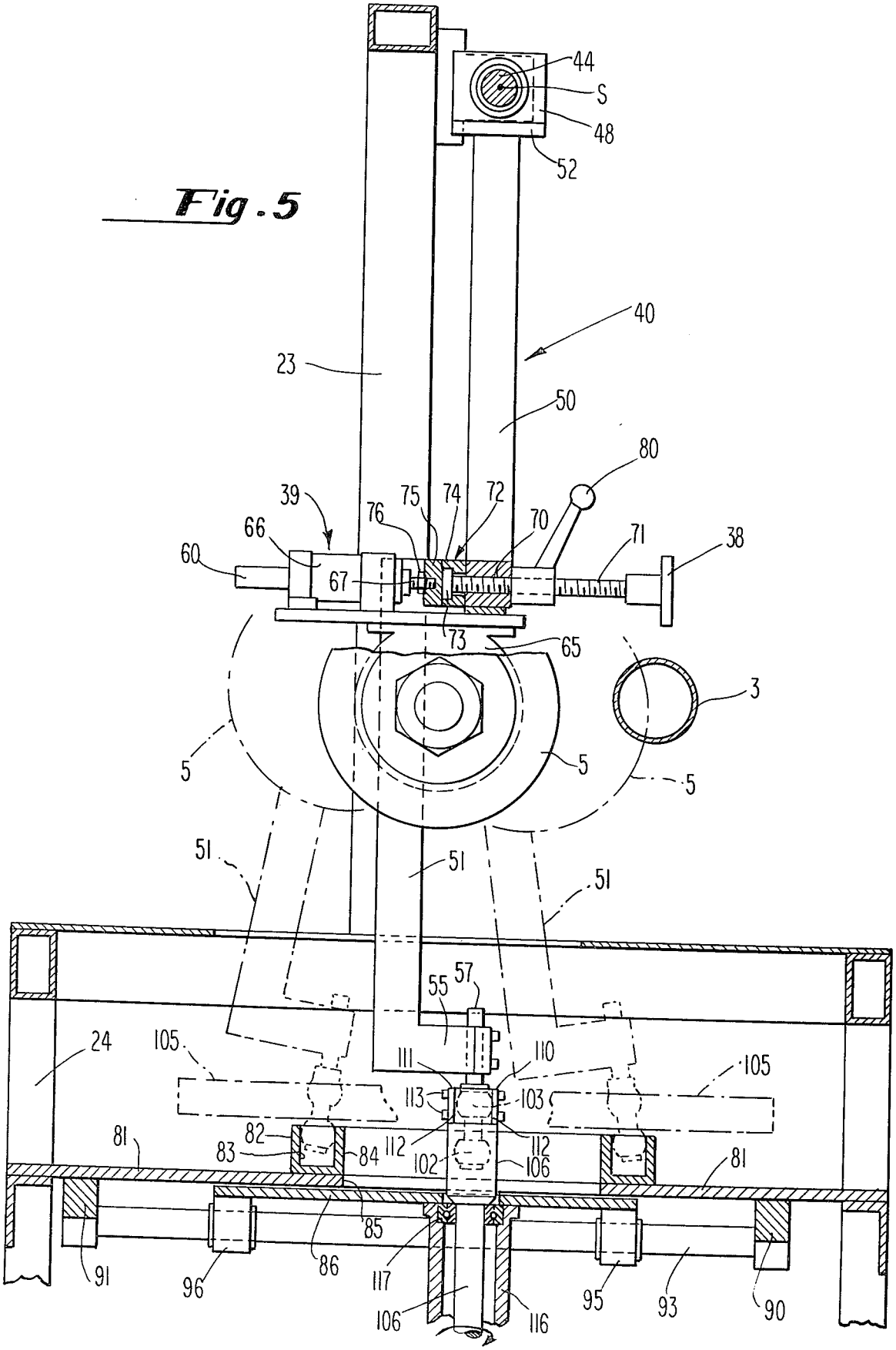
FIG. 5 is a side elevational view taken along the lines 5—5 of FIG. 3.

With reference to FIG. 5, a nut 70 is formed in the cross piece 53. The nut carries an adjusting screw 71. The left hand end of the screw 71 is connected to the piston rod 67 by coupler means 72 and the right hand end of the screw 71 carries knob or hand wheel 38. The coupler means 72 includes a head 73 on the screw 69 making a rotary, sliding fit in a cavity of a base 74 to which is fixed a head 75 by nuts not shown. The threaded end of the piston rod 67 is threaded in the head 75 and held by nut 76. Rotation of the knob or hand wheel 37 rotates the adjusting screw 71 and axially moves same. This moves the piston rod 67 and its piston. The screw 71, hence the piston, are locked in adjusted position by the nut 80 mounted on the rod 71 and bearing on the cross piece 53.

The drive mechanism for the orbital motion of the saw blade 5 will now be described.

The lower frame 24 fixedly mounts a horizontally extending support plate 81. On the top surface of the support plate 81 is fixedly mounted to a circular track means 82. The track means is a solid member and is formed with a circular cam channel 83. The center of the channel lies in a vertical plane containing the axis S. The cam means is also formed with an elongated slot 84 (FIGS. 5 and 6) which extends co-axial and symmetrical with a diameter of the cam channel 83 and is oriented generally normal to the vertical plane containing the axis S and the center of the cam channel. In the support plate 81 there is formed a slot 85 which extends axially and laterally co-extensive with the slot 84.

Underneath the fixed support plate 81 is mounted an adjustable plate 86 which mounts and serves as a carrier for certain of the drive mechanism. The plate 86 is mounted for adjustment in a path extending the same as the slot 84.

The mounting means for the plate 86 comprises a pair of bars 90 and 91 fixed at the front and rear of the support plate 81. The bars fixedly mount a pair of slide rods 92 and 93 which are oriented normal to the vertical plane containing axis S. The rod 92 carries a bearing 94 and the rod 93 carries bearings 95 and 96. The bearing 94, 95 and 96 slidably mount the adjustable plate 86 for linear reciprocating motion. The position of the adjustable plate 86 is determined by the hand wheel 37 operating the adjusting screw 100 rotatably mounted on the frame 24 and threadingly engaged with the nut 101 fixed to the underside of the plate.

As best noted in FIGS. 3, 4 and 5 the cam channel 83 receives and guides the lower roller assembly or follower 102 which is a conventional spherical ball bearing type roller. The roller assembly 102 is mounted on the cam roller stud 57. Also mounted on the cam roller stud 57 is the upper roller assembly or pusher 103 which is identical to the assembly 102. With reference to FIG. 6, the roller assembly 103 rides in a slot 104 in a drive crank 105. The slot 104 extends substantially throughout the length of the drive crank.

The drive crank 105 is secured to the top of a crank shaft 106 which is adapted to be roated by means described below. The axis of the crank shaft 106 is co-axial with the center of the cam channel 83. With reference to FIGS. 4 and 6, the drive crank 105 comprises a pair of plates 110 and 111 the inner ends of which engage flats 112 (FIG. 5) on the top of the shaft 106 and are secured by nut/bolt assemblies 113. The outer ends are joined by a block 114 and secured by nut/bolt assemblies 115.

From an inspection of FIGS. 3 thru 6 it will be apparent that when the drive crank 106 is rotated in the counterclockwise direction (see arrows 107 in FIG. 6), the cam roller stud 57 is caused to move by upper roller assembly 103 and will be constrained to move in a circular path by virtue of the lower roller assembly 102 operating in the cam channel 83. The upper part of the cam roller stud being fixed to the saw blade frame 40 will cause the frame to slide along and to tilt with respect to the main slide shaft 44. As mentioned heretofore, the sliding and tilting motions of the frame 40 causes the tip of the saw blade 5 to follow the elliptical path 43 (FIG. 6).

It will be understood that during the above motion the upper roller assembly 103 does not slide back and forth in the slot 104 of the crank arm 105. The slot 104 is elongated for adjustment purposes as will be noted later.

The drive mechanism (mounted on the underside of the adjustable plate 86) for rotating the crank 105 will be described.

A crank shaft housing 116 is fixed to the underside of the adjustable plate 86 so as to be movable with the plate. The housing carries an upper bearing 117 and a lower bearing (not shown) located at the bottom of the housing. The bearings rotatably support the crank shaft 106. The lower end of the crank shaft 106 extends outwardly of the housing 116 and carries a crank shaft gear 120.

A gear reducer 121 is fixedly mounted on the underside of the adjustable plate 86 to be movable with the plate. The output shaft 122 of the gear reducer carries drive gear 123 meshing with the crank shaft gear 120. The gear reducer 121 has an input shaft 124 carrying pulley 125.

An orbit drive motor and control assembly is indicated at 126. The assembly is fixed to the underside of the adjustable plate 86 and movable therewith. The assembly includes a variable speed motor and a mechanical means for further modifying the speed and controls speed at which the/saw blade 5 travels around orbit 43.

The assembly 126 is "L" shaped having a lower part 127 housing the variable speed motor and an upper part 128 housing the mechanical controls and fixed to the underside of the adjustable plate 126.

The main output shaft of the assembly 126 is indicated at 130. The shaft carries the pulley 131. The pulley 131 is drivingly connected by belt 132 to the pulley 125 on the input shaft 124 of the speed reducer 121.

The operation of the assembly 126 will be explained in connection with FIG. 8. At this juncture however it is pointed out that the mechanical control is effected by operation of the hand wheel 36. The wheel 36 is rotatably mounted on frame 24 and carries a pinion 133 meshing with a pinion 134 (FIGS. 3 and 4) connected to drive shaft means 135. The right hand end of shaft 135 has section 136 connected to pinion 133 and the left hand end 137 is control shaft extending out of assembly 126. The center section 138 has a spline 138*a*. Universal joints 139 join the sections 136, 137 and 138. The spline connection 138*a* permits adjustment of the adjustable plate 86 without disturbing the setting of the hand wheel 36.

Thus, with the above arrangement, the speed of the output shaft 130 of the assembly 126, acting thru the drive belt 132, reducer 122, and gears 123 and 120 will drive the crank shaft 106.

In FIG. 8, we have presented in simplified form, a block diagram of the electrical system for the winder and saw. Since the various individual components such as motors, motor controllers, air cylinders etc. are known per se such a block diagram will be adequate for those skilled in the art.

The power supply 140 for the system is standard 60 cycle, 3-$\phi$,220 volts ac. The frequency and voltage are fixed. Power is fed to the disconnect 141 and circuit breaker or fuse means 142.

The breaker means 142 is connected to a motor control 143 which feeds the saw blade rotation motor 65. The control 143 is a standard type comprising a motor starter, over-load protective means and on/off switch.

The breaker means 142 is also connected to the motor control 144 which feeds the master speed control 10. The master speed control is diagramtically illustrated in FIG. 8-A.

A three phase, constant speed induction motor 145 has its rotor shaft (output) connected to the input shaft of a variable speed transmission unit 146. The output shaft of the tranmission is connected to the rotor of a three phase alternator 147. By varying the speed of the alternator rotor, the frequency of the output voltage is proportionally changed. The transmission 146 is adapted to change the speed of the alternator rotor. Power for the change is supplied by the motor 148 under the direction of the speed control 149 which starts and stops the motor 147 and determines its direction of rotation.

Thus, the frequency of the output voltage of the alternator 147; i.e. the unit 10, can be varied as desired.

The output voltage of the unit 10 is fed to the motor control 150 for the winder drive motor 14. This motor is a conventional three phase induction motor. The speed of the motor is changed by changing the frequency of the supply voltage. Thus the speed of the output shaft 14*a* of 14 is under the control of the speed control 149 of the unit 10.

The output voltage of the unit 10 is also fed to the motor control 151 for the orbit drive motor 129 of the unit 126. The motor 129 is a three phase induction motor similarly as the motor 14. The speed of the orbit drive motor 129 hence output shaft 130 is under the control of the speed control 149 of the unit 10.

Since both the motor 14 and the motor 129 are fed from the same source whose frequency can be changed, the speeds of the two motors or output shafts 14*a* and 130 will be proportionaly increased or decreased with change in source frequency. The speed of the shaft 130 can be modified with respect to the speed of shaft 14*a* as noted following.

The upper unit 128 of the assembly 126 is a variable speed transmission. The operation of the transmission is controlled by the wheel or knob 36. A typical, conventional transmission schematically shown in FIG. 8-B, comprises a pair of a pulley units 152*a* and 152*b* connected by a drive belt 153, the pulley 152*a* being connected to the orbit drive shaft 154 of the motor 129 of the assembly 126 and the pulley 152*b* connected to the assembly output shaft 130. Rotation of the knob 36 operated translator 155 which changes the radius relationship between the pulleys and thereby changing speed of the shaft output 130 with respect to the speed of the shaft 154 motor 129.

Thus, it will be seen that with the winder motor 14 and orbit drive motor 129 rotating at fixed relative speeds (due to the frequency of the supply voltage) the speed of the output shaft 130 of the unit 126 can be varied by manipulation of knob 36. As noted shortly, the speed of the shaft 130 is varied for purposes determining the rate at which the saw blade arrives at the linear portion of the orbit for the cutting operation and thereby determine the length of the stick to be cut.

From the foregoing description, it will be apparent that the only connection between the winder and the saw is the tube 3 and the electrical connections between the master speed control 10 and the winder and orbit drive motors. These electrical connections are run underfloor in a trench duct or overhead in a cable tray.

With respect to the control of the length of cut, the following describes the procedure for controlling the squareness or quality of cut after the length is set.

As noted heretofore, rotation of the wheel 37 shifts the plate 86. The shifting of the plate 86 also shifts the crank shaft 106 which moves along the slot 84. With reference to FIG. 6, if the shaft 106 is shifted from the center position shown to the rear, the frame 40, hence the blade 5, will travel faster in the front part of the orbit 43 than in the rear part of the orbit 43. If the shaft 106 is moved to the front, the speed of the blade in the front part of the orbit will be slower than the rear. In the foregoing, the linear shifting of the adjustable plate 86 is important from the standpoint of maintaining the integrity of the effects of the adjustment.

Since the linear speed of the tube is constant, the linear speed of the blade in the portion 43*a* can be matched to the tube speed by shifting the shaft 106 as described. By matching the speeds the squareness or quality of the cut can be enchanced.

As will be apparent the slot 104 in the crank 105 accomodates the shifting by that the driver 103 can move (in or outwardly) in the slot.

In FIG. 9 parts (a), (b) & (c) we have diagramatically illustrated the operation of the air cylinder 66. The cylinder has piston 156 whose rod 67 is connected to adjusting mechansim as heretofore described. A standard solenoid operated valve 157 is connected to an air supply 160 and also has flexible lines 161 and 162 respectively connected to chambers on opposite sides of the piston 156. The valve has exhaust line 163. The solenoid 164 operates the valve spool in the usual manner. For cutting purposes, air enters the line 162 and exhausts thru the valve to line 163 to drive the cylinder (and blade 5) inwardly with respect to the piston 156 as seen in part (b). For the skip-cut operation the air flow is reversed to drive the cylinder (and blade 5) outwardly as noted in part (c).

In FIG. 10 we have shown circuitry for controlling the solenoid 164 to condition the saw for normal cutting and for skip-cutting. The circuit is fed from power lines 165. A double pole-double throw switch 166 has a "Normal" and a "Skip-Cut" position which control power to lines 167 and 168. The line 167 feeds power to solenoid 164 to cause the same to move saw blade 5 to cutting condition. The line 160 feeds power to the solenoid to cause the same to move the saw blade out of the cutting condition.

Following are brief descriptions of the procedures for setting up the saw blade for regular cuts and for initiating the skip-cut feature.

For regular cuts, the switch 166 is put in the Normal position and the knob 138 manipulated to back off the blade so that it will not engage the tube. The winder and saw are started and the knob 149 of the control 10 manipulated so that the tube moves at some desired linear speed until it moves past the blade. The winder and saw are stopped. The knob 38 is adjusted to bring in the blade until it just knicks the tube. The winder and saw are again started. The knob 36 is then adjusted to vary the speed of the saw around the orbit until the blade enters or knicks the tube at the desired intervals and thus determing the length of stick;

The winder and saw are stopped and the knob 38 rotated to bring the blade inwardly so as to effect a full cut;

The winder and saw are again started and the squareness of the cut made as desired by manipulation of hand wheel 37 which functions to match the speed of the blade in the linear portion of the orbit with the linear speed of the tube.

For the skip-cut condition a sensor switch 169 and a re-set switch 170 are employed in conjunction with the switch 166. The switches 169 and 170 are conventional micro-switches. The sensor switch 169 is set up in the path of the tube in a position determined by the length of tube desired. The re-set switch 170 is set up on the frame 24 to be contacted (and closed) by the saw blade frame 40 after the blade 5 has finished a cut and is just starting to reverse direction in the orbit. In this particular instance the switch 170 is positioned (see FIG. 3) to be contacted by the bearing 148.

For skip cutting, switch 166 is moved to the skip-cut position. When the sensor switch 170 is contacted by the bearing 48 the line 168 feeds power to the solenoid 164 which in turn operates the valve 157 to cause the cylinder 66 to move the saw blade out of the cutting condition. The valve 157 will hold the blade out until the line 167 is again energized and the solenoid moved in the opposite direction. The tube 3 passes the cutting position of blade 5 without being cut. The switch 170 is opened and closed as the frame 40 moves back and forth but this has no affect on solenoid 164.

When the end of the tube reaches its designated location the sensor switch 169 is closed and line 167 feeds power to the solenoid 164 which operates valve 157 to move the saw blade into cutting condition. When the blade reaches the linear portion 43*a* of the orbit, the tube is cut and falls away from the sensor switch 169 to cause same to open. When the frame 40 reaches the right hand position the re-set switch 170 is closed so that line 168 feeds power to solenoid 164 and the blade is moved out of the cutting condition. The saw continues to cut sticks of extended length. The skip cut can be terminated by throwing switch 166 to the normal position.

In FIG. 11, we have illustrated in simplified form, a block diagram of the electric-hydraulic power and control arrangement for the winder and the saw. Like arrangement of FIG. 8, the individual components are known per se. Certain components are identical to the components of FIG. 8 and will be identified by the same name and number.

The power supply 140, the disconnect 141 the breaker 142, the motor controls 143 and 144 and the saw blade rotation motor 65 are the same as in FIG. 8.

The master speed control 10' is diagramatically illustrated in FIG. 11-A and includes the three phase, constant speed induction motor 170 whose output shaft is connected to drive a variable volume hydraulic pump 171. The pump is fed from the fluid supply 172. The control knob 173 changes the volume displacement of the pump and thereby changes the rate of fluid flow thru discharge line 174.

The line 174 is connected to feed the proportionator 175 via emergency stop valve 176. The proportionator functions to split the fluid flowing thru discharge line 174 into two porportionately equal flow path respectively exiting thru discharge lines 176 and 177 which feed the hydraulic winder motor 180 and the hydraulic orbit drive motor 181.

The winder motor output shaft 182 (like shaft 14*a*) is connected to drive the winder 14 and the orbit drive motor shaft 183 (like shaft 130) is connected to drive the crank shaft 106.

Since the winder motor 180 and orbit drive motor 181 are fed from the same source (pump 171) the flow rate of which can be varied, the speeds of the two motors hence their output shafts 182 and 183 will be proportionately increased or decreased by manipulating knob 173. The change in flow rate of pump 171 to change the speeds of motors 180 and 182 is analogous to changing the frequency of the alternator 147 (FIG. 8-A) feeding the winder motor 14 and orbit drive motor 129 to thereby change the speeds of the output shafts 14*a* and 130.

As mentioned in connection with the description of FIG. 8, the speed of the output shaft 130 can be varied with respect to winder shaft 14*a* for purposes of determining the length of the stick to be cut. A similar arrangement is made to vary the speed of the output shaft 183 with respect to winder shaft 182. This is done by that motor 181 is of the variable volume type having a control knob 184 to vary the motor displacement hence to modify the speed of the shaft 183.

Before closing, it is to be noted that the knobs 36, 37 149 and 183 are manually operable means readily available to the machine operator by that the knobs 36 and 37 are on the front of the saw and the knobs 149 and 184 are on the control panel 17 of the winder.

We claim:

1. In the combination of a paper tube winder having a drive system including a drive motor having connections to move formed tubing at a constant linear speed along an axis and an orbital saw having means supporting a saw blade and having a drive system for moving the saw blade in a orbital path including a substantially linear portion wherein the blade engages a tube for cutting the same, the improvement comprising:

in the winder drive system, the drive motor having a winder drive shaft;

in the saw blade orbit drive system an output shaft providing power to move the saw blade in said orbital path and an orbit drive motor for driving the output shaft;

first control means connected to said systems for operating said drive motors including a first manually actuatable means readily available to the operator to vary the speed of the output shaft and the speed of the winder drive shaft in the same amount;

second control means connected to said orbit drive motor including second manually actuatable means readily available to the operator to change the speed of the output shaft with respect to the speed of the winder drive shaft;

third control means in said saw blade orbit drive system including third manually actuatable means readily available to the operator to adjust the speed of the saw blade in the linear portion of said orbital path; and said first, second and third control means providing;

for said first control to set the linear speed of the tubing and the speed of the saw blade in said orbital path and then for the second control means to change the speed of the saw blade in the orbital path to control the rate at which the saw blade arrives at said linear portion for the cutting operation and thereby determining the length of a stick to be cut;

for said third control means to adjust the speed of the saw blade in the linear portion of said orbital path to match the linear speed of the tube and thereby control the squareness of the cut; and for said first control means, after said stick length and squareness of cut have been determined, to change the speed of the output shaft and the speed of the winder drive shaft in the same amount thereby change the rate at which the sticks are cut without changing the length thereof.

2. In the combination of a paper tube winder having a drive system including a drive motor having connections to move formed tubing at a constant linear speed along an axis and an orbital saw having means supporting a saw blade and having a drive system for moving the saw blade in a orbital path including a substantially linear portion wherein the blade engages a tube for cutting the same, the improvement comprising:

in the winder drive system, the drive motor being a hydraulic motor having an output shaft, the output shaft providing the power to move the saw blade in said orbital path;

first control means connected to said systems having means to supply fluid to said drive motors for operating the same including a first manually actuatable means readily available to the operator to supply the fluid whereby to vary the speed of the output shaft and the speed of the winder drive shaft in the same amount;

second control means connected to said orbit drive motor including manually actuatable means readily available to the operator to change the speed of the output shaft with respect to the speed of the winder drive shaft;

third control means in said saw blade orbit drive system including third manually actuatable means to adjust the speed of the saw blade in the linear portion of said orbital path; and said first, second and third control means providing;

for said first control to set the linear speed of the tubing and the speed of the saw blade in said orbital path and then for the second control means to change the speed of the saw blade in the orbital path to control the rate at which the saw blade arrives at said linear portion for the cutting operation and thereby determining the length of a stick to be cut;

for said third control means to adjust the speed of the saw blade in the linear portion of said orbital path to match the linear speed of the tube and thereby control the squareness of the cut; and for said first control means, after said stick length and squareness of the cut have been determined, to change the speed of the output shaft and the speed of the winder drive shaft in the same amount to thereby change the rate at which the sticks are cut without changing the lengths there.

3. In the combination of a paper tube winder having a drive system including a drive motor having connections to move formed tubing at a constant linear speed along an axis and an orbital saw having means supporting a saw blade and having a drive system for moving the saw blade in an orbital path, including substantially linear portion wherein the blade engages a tube for cutting the same:

in the winder drive system, the drive motor being a three phase induction motor having a winder drive shaft;

in the saw blade orbit drive system, a three phase induction motor having an orbit drive shaft;

in the saw blade orbit drive system, an output shaft having connections to said orbit drive shaft to be driven thereby and having connections to move the saw blade in said orbital path;

master control means connected to said systems having means to supply A.C. voltage to said drive motors for operating the same including mechanism to vary the frequency of the supply voltage whereby to vary the speed of the orbit drive shaft and the speed of the winder drive shaft in the same amount;

said connections between the orbit drive shaft and the output shaft being a first manually adjustable control means operable to change the speed of the output shaft with the respect to the speed of the orbit drive shaft;

second manually adjustable control means connected in the saw blade orbit drive system to adjust the speed of the saw blade in the linear portion of said orbital path; and said control means providing;

for said master control to set the linear speed of the tubing and the speed of the saw blade in said orbital path and for the first control means to change the speed of the saw blade in the orbital path to control the rate at which the saw blade arrives at said linear portion for the cutting operation and thereby determining the length of a stick to be cut;

for said second control means to adjust the speed of the saw blade in the linear portion of said orbital path to match the linear speed of the tube and thereby control the squareness of the cut; and for said master control means, after said stick length and squareness of cut have been determined, to change the frequency of the supply voltage and thereby change the rate at which the sticks are cut without changing the lengths there.

* * * * *